United States Patent [19]

Otsuka et al.

[11] Patent Number: 4,565,987

[45] Date of Patent: Jan. 21, 1986

[54] ELECTROMAGNETIC CONTACTOR

[75] Inventors: Shigeharu Otsuka; Yuji Mizuno, both of Aichi, Japan

[73] Assignee: Mitsubishi Denki Kabushiki Kaisha, Tokyo, Japan

[21] Appl. No.: 644,302

[22] Filed: Aug. 27, 1984

[30] Foreign Application Priority Data

Sep. 27, 1983 [JP] Japan ..... 58-178493

[51] Int. Cl.[4] ..... H01H 50/02

[52] U.S. Cl. ..... 335/131; 335/198

[58] Field of Search ..... 335/131, 132, 198

[56] References Cited

U.S. PATENT DOCUMENTS 3,099,728 7/1963 Scheib, Jr. ..... 335/131

*Primary Examiner*—Harold Broome

*Attorney, Agent, or Firm*—Sughrue, Mion, Zinn, Macpeak and Seas

[57] ABSTRACT

An electromagnetic contactor having normally open and normally closed contact pairs 22, 26 includes a movable crossbar 12 having apertures 14 each defining two guide surfaces 18*a*, 18*b*; 18*c*, 18*d* inclined at different angles for guiding spring biased movable contact members 16 disposed in the apertures. These inclined surfaces serve to jam the crossbar against the base 10 of the contactor when the crossbar is moved in a direction to open fused contact pairs during the initial spring decompression movement of the crossbar, to thereby prevent the normally open and normally closed contact pairs from being closed at the same time.

6 Claims, 10 Drawing Figures

ELECTROMAGNETIC CONTACTOR

BACKGROUND OF THE INVENTION

1. Field of the Invention:

The present invention relates to an electromagnetic contactor of the type having normally open and normally closed contacts.

2. Description of the Prior Art

The electrical circuits for the bidirectional motors of stamping presses, for example, are typically opened and closed by an electromagnetic contactor or relay.

FIG. 1 of the accompanying drawings shows an exploded perspective view of such a conventional electromagnetic contactor, which includes an attachment base 110 supporting a fixed iron core 114 on which a control coil 112 is mounted. A body frame 116 is screwed to the base and accommodates therein a crossbar 118 which is slidable with respect to the body frame. A movable iron core 120 is attached to the crossbar by a resilient strip 122 in confronting relation to the fixed core 114. Springs 124 are interposed between the crossbar 118 and the base 110 for normally urging the crossbar upwardly to cause the movable core 120 to be spaced upwardly from the fixed core 114.

When an exciting voltage is applied to or removed from the control coil 112, the movable core 120 is brought into or out of contact with the fixed core 114 to thereby slide the crossbar 118 upwardly or downwardly to open or close the electrical circuits of a motor, for example.

Fixed contact members 128 (only one shown) having contacts 126 are secured to the body frame 116. A movable contact member 132 is slidably disposed in an aperture 118*a* in the crossbar 118 and is biased downwardly by a holding spring 130. The movable contact member has a pair of contacts 134 on opposite ends thereof in confronting relation to the fixed contacts 126.

In response to sliding movements of the crossbar 118, the movable contacts 134 are moved into and out of contact with the fixed contacts 126 to open and close the electrical circuits.

When the fixed and movable contacts are brought into and out of contact with each other, an arc is produced between them. To prevent damage due to arc heating and the arc from flashing outwardly, an arc cover 136 is detachably mounted on the body frame 116.

FIGS. 2 through 4 schematically illustrate the contact arrangements in the prior art electromagnetic contactor. A crossbar 12 is slidably mounted in a base 10 of the electromagnetic contactor. As shown in FIG. 3, the crossbar has a plurality of apertures 14 in each of which a movable contact member 16 is slidably disposed with respect to guide surfaces 18. These guide surfaces may comprise projections or ledges outstanding from the aperture walls or depressions therein, for example, which mate with corresponding notches in or tabs on the movable contact member. Such notches or tabs are preferably extended rearwardly of the contact member to stabilize its sliding movement along the guide surfaces. A holding spring 20 is positioned in each aperture 14 with one end engaging a projecting pedestal 19 and the other end engaging a central portion of the movable contact member 16. The latter has a pair of movable contacts 22 on opposite ends thereof. Fixed contact members 24 are secured to the base 10 and have fixed contacts 26 on their distal ends confronting the respective movable contacts 22. The movable contact member 16 has slides which are slidable along the guide surfaces 18.

The movable and fixed contacts 22 and 26 jointly constitute respective contact pairs in the crossbar apertures 14. The contact pairs include as many normally open contacts (FIG. 2) and as many normally closed contacts (FIG. 4) as required for the electrical circuits being controlled.

The crossbar 12 is longitudinally slidable under attractive forces from an electromagnetic means (such as the coil and cores of FIG. 1) to bring the movable and fixed contacts 22 and 26 into and out of contact with each other to open and close the electrical circuits.

The distance between the movable and fixed contacts 22 and 26, which they must traverse when opening and closing, is shorter than the sliding movement stroke of the crossbar 12. With the normally open contact pair as shown in FIG. 2, for example, when the crossbar 12 is driven in the direction of arrow A, the movable and fixed contacts 22 and 26 are brought into mutual engagement. During the final portion of the sliding movement of the crossbar 12 the movable contact member 16 remains stationary due to its abutting engagement with the fixed contacts 26, and thus merely compresses the spring 20. Stated another way, as the crossbar 12 slides in the direction of arrow A, the movable contact member 16 slides in the direction of arrow B relative to the crossbar, opposite to the direction in which the crossbar is attracted, within the aperture 14, causing the contacts 22 and 26 to bear against each other by the compressive force of spring 20.

Conversely, with the normally closed contact pair as shown in FIG. 4, the initial sliding movement of the crossbar 12 in the direction of arrow A merely serves to decompress the spring 20, with the contacts remaining closed, until the movable contact member 16 abuts the wall 30 at the end of the aperture 14. Thereafter the movable contact member is carried in the direction in which the crossbar 12 is attracted to thereby separate the movable and fixed contacts 22 and 26 from each other.

The normally open and normally closed contact pairs are prevented from being simultaneously engaged during the sliding movement of the crossbar 12; the normally open contact pairs are closed only after the normally closed contact pairs have been opened. It is essential to prevent such simultaneous closing of the normally open and normally closed contact pairs to avoid the dangerous operation of a stamping press machine, for example. This is achieved by constructing the contactor such that the separation distance between the open contacts 22 and 26 in FIG. 2 is greater than the distance between the movable contact member 16 and the aperture end wall 30 in FIG. 4.

As described above, the electrical circuits are opened and closed in response to contacting and separating movements of the normally open and normally closed contact pairs, and the guide surfaces 18 extend parallel to the longitudinal axis of the crossbar 12. If one of the contact pairs becomes fused, however, the movable contact member 16 tends to flex in the direction of sliding movement of the crossbar as the latter slides at the time the fused contacts are to be separated. With electromagnetic contactors of the type in which the distance between the open fixed and movable contact pairs is relatively short, the extent to which the movable contact member 16 flexes may exceed the contact separation distance less the decompression travel of the spring 20. Such a condition results in the normally open and normally closed contact pairs being simultaneously closed, thus making the press device or the like being controlled more susceptible to abnormal or dangerous conditions.

SUMMARY OF THE INVENTION

With the foregoing problem in mind, it is an object of the present invention to provide an electromagnetic contactor having normally open and normally closed contact pairs which are positively prevented from being closed at the same time even when one of the contact pairs is fused.

To achieve this and other objects, each of the crossbar apertures has two differently angled, sloping guide surfaces against which the movable contact member slides, one of said guide surfaces being for a normally open contact pair and the other being for a normally closed contact pair.

If none of the contact pairs are fused the movable contact member is cammed or driven upwardly to a slight extent during the initial spring decompression movement of the crossbar. If a contact pair is fused, however, such upward movement is prevented, and instead the crossbar is cammed or driven downwardly against its slide surface on the base. This wedging or jamming effect halts the further movement of the crossbar before any open contacts are closed, thus preventing the normally open and normally closed contacts from becoming simultaneously closed.

DETAILED DESCRIPTION OF THE PREFERRED EMBODIMENTS

Figure 1:
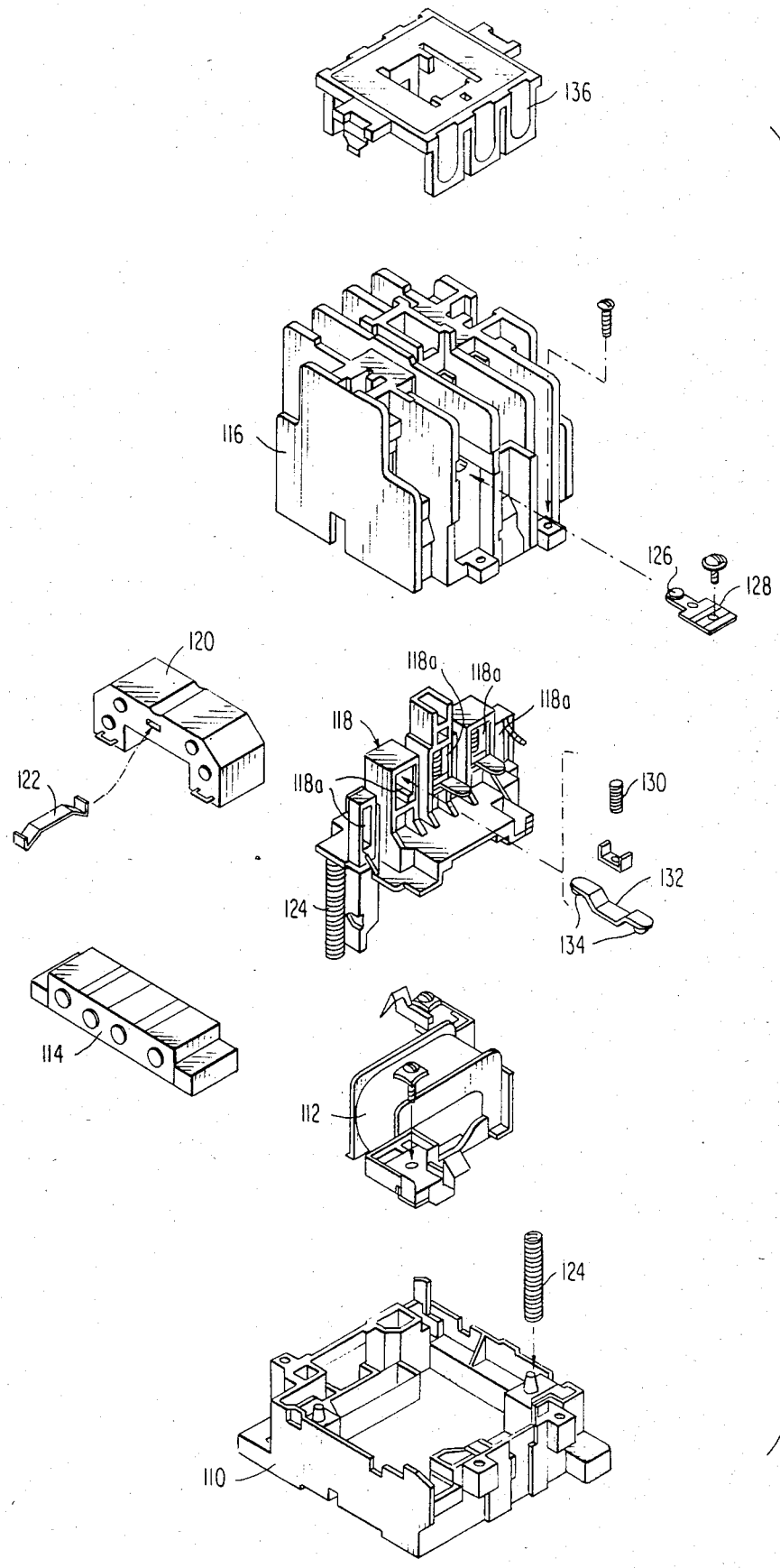
FIG. 1 PRIOR ART
FIG. 1 is an exploded perspective view of a conventional electromagnetic contactor.
Figure 2:
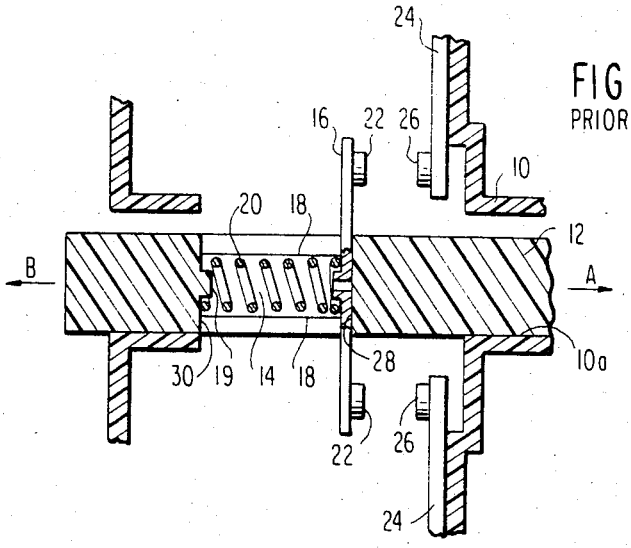
FIG. 2 PRIOR ART
FIG. 2 is a fragmentary cross-sectional view of a normally open contact arrangement in a prior art contactor as shown in FIG. 1.
Figure 3:
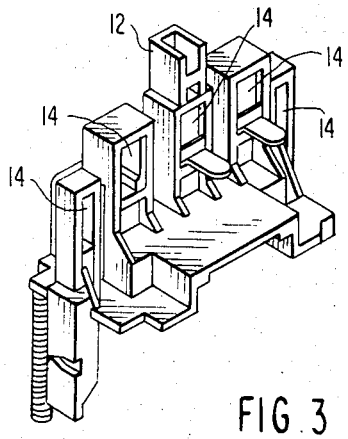
FIG. 3 PRIOR ART
FIG. 3 is a perspective view of a crossbar in the contactor of FIG. 1.
Figure 4:
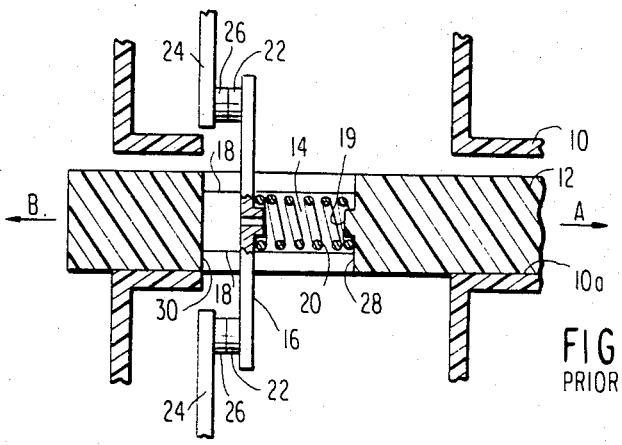
FIG. 4 PRIOR ART
FIG. 4 is a fragmentary cross-sectional view of a normally closed contact arrangement in a prior art contactor as shown in FIG. 1.
Figure 5:
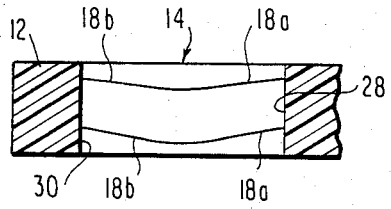
FIG. 5 is a fragmentary cross-sectional view of a crossbar in a contactor according to the present invention, showing two differently slanted guide surfaces in a crossbar aperture.
Figure 6:
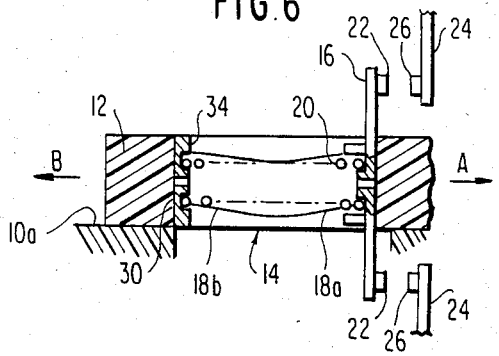
FIG. 6 is a cross-sectional view showing a normally open movable contact in the crossbar aperture of FIG. 5.
Figure 7:
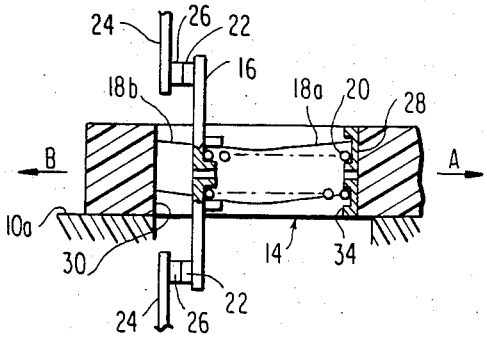
FIG. 7 is a cross-sectional view showing a normally closed movable contact in the crossbar aperture of FIG. 5.

FIGS. 5–7 schematically show the construction of a first embodiment of the invention. Like or corresponding parts to those shown in FIGS. 2 through 4 are denoted by the same reference characters, and will not be described in detail.

According to the invention, the guide surfaces 18 in the crossbar apertures 14 are sloped or inclined to prevent the movable contact member 16 and crossbar from undergoing sufficient sliding movement to close the open contacts of the former when one of the closed contact pairs is fused, thereby stopping the sliding movement of the crossbar to reliably prevent the normally open and normally closed contact pairs from being simultaneously closed.

In the first embodiment under consideration, the crossbar aperture 14 has two guide surfaces **18*a*, 18*b*** formed with sloping surfaces of different angles of inclination to accommodate, respectively, a movable contact member for normally open and normally closed contact pairs to prevent them from being simultaneously closed.

More specifically, as shown in FIG. 5, the guide surfaces **18*a* in the crossbar aperture 14 for the movable contact member 16 of a normally open contact pair as shown in FIG. 6 are progressively slanted or inclined to guide or "cam" the movable contact member in an upward direction—away from the slide surface 1O*a* of the base 10**—as the crossbar is attracted in the direction of arrow B.

The condition in which the movable and fixed contacts 22, 26 of the normally open contact pair of FIG. 6 are fused together while the normally closed contact pair is being closed will first be considered. When the contacts are to be separated by moving the crossbar 12 in the direction of arrow B, the movable contact member 16 bears against the inclined guide surfaces **18*a*** in the crossbar aperture and is guided or cammed upwardly during the initial spring decompression movement of the crossbar *if* none of the closed contact pairs are fused. During such upward movement the faces of the contacts 22, 26 wipe across each other to a small extent.

Since the movable and fixed contacts 22, 26 of FIG. 6 are assumed to be fused together, however, the movable contact member 16 necessarily remains vertically stationary rather than being cammed upwardly, and instead the crossbar 12 is cammed or pressed downwardly against the slide surface **1O*a* of the base 10**. This effectively jams or wedges the crossbar against the base and prevents its further sliding in the direction of arrow B, with the consequence that any normally closed but now open contact pairs controlled by other crossbar apertures are reliably prevented from being closed.

FIG. 7 illustrates a movable contact member 16 for a normally closed contact pair mounted in a crossbar aperture 14 and slidably engaged with guide surfaces **18*b* slanted in a direction opposite to the surfaces 18*a*. If the normally closed contact pair of FIG. 7 is fused together, any movement of the crossbar 12 in the direction of arrow A similarly wedges the crossbar against the base 10 as described above to prevent it from moving a sufficient distance to close any of the open contact pairs controlled by other crossbar apertures. The angles of inclination of the surfaces 18*a*, 18*b*** are selected to ensure the jamming or wedging of the crossbar against the base exclusively during the spring decompression travel—well before the contact separation distance is traversed.

The jamming of the crossbar also jams the movable contact member 16 against its inclined guide surfaces, of course, and this serves to prevent the contact member from undesirably wobbling or chattering in the aperture 14. Another useful side effect of the invention is the wiping of the contacts 22, 26 during both opening and closing, which implements a self-cleaning action.

As will be appreciated from the foregoing, by reason of each crossbar aperture being provided with two centrally merging but differently sloped guide surfaces 18*a*, 18*b* in the manner of a "double chevron", it is adaptably able to equally accommodate a movable contact member for either normally open or normally closed contact pairs.

In this embodiment the spring pedestals 19 of FIGS. 2 and 4 are removed in order to prevent any interference at the end of an aperture with a movable contact member and to thus render the crossbar construction universally adaptable to either normally open or normally closed contact pairs. To supplant such structural deletion, insertable spring seats 34 are used. Thus, in FIG. 6 a spring seat 34 has been inserted between the aperture end wall 30 and the free end of the spring 20 opposite the movable contact member. Similarly, in FIG. 7 a spring seat 34 is shown inserted between the free end of the spring and the aperture end wall 28.

Figure 8:
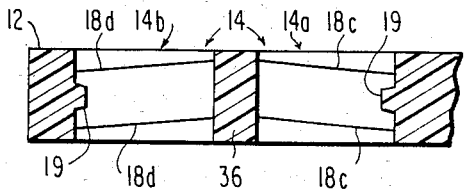
FIG. 8 is a fragmentary cross-sectional view of a contactor crossbar according to another embodiment of the invention, showing two guide surfaces slanted in different directions and separated by a support wall.
Figure 9:
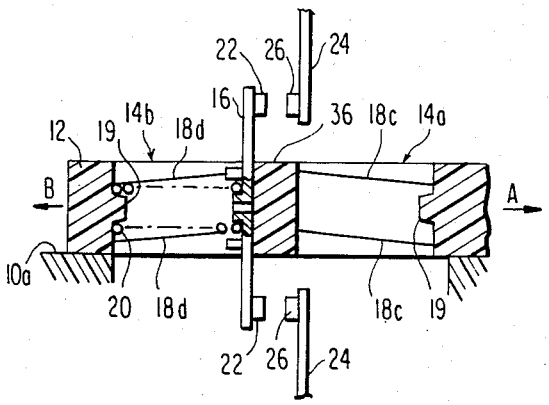
FIG. 9 is a cross-sectional view showing a normally open movable contact in the crossbar aperture of FIG. 8.
Figure 10:
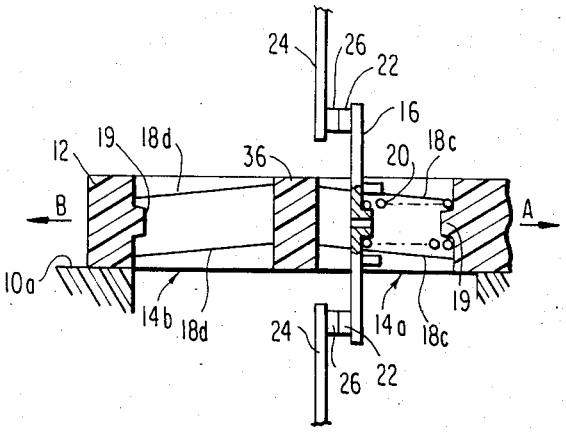
FIG. 10 is a cross-sectional view showing a normally closed movable contact in the crossbar aperture of FIG. 8.

The second embodiment shown in FIGS. 8–10 is generally similar to the first embodiment of FIGS. 5–7 and functions in substantially the same manner, but differs from the first embodiment in the following respects:

(a) each crossbar aperture 14 is split or divided into two separate apertures or aperture portions 14*a*, 14*b* by a central support wall 36 which serves as an abutment for the movable contact member of any open contact pairs, as seen in FIG. 9. The wall 36 need not extend completely across the aperture, but instead two partial walls may be provided projecting inwardly towards each other a sufficient distance so that the remaining gap between them is less than the width of the movable contact member 16, (b) the slope angles of the guide surfaces 18*c*, 18*d* are reversed relative to the guide surfaces 18*a*, 18*b* of the FIGS. 5–7 embodiment, (c) the fixed contact members 24 and the fixed contacts 26 carried thereby are more centrally disposed proximate the support wall 36 rather than being at the ends of the crossbar apertures, (d) the movable contact member 16 for normally open contact pairs (FIG. 9) is disposed in the left aperture 14*b* rather than being at the right end of the unitary aperture as shown in FIG. 6, and vice versa for the movable contact members of normally closed contact pairs (FIG. 10), and (e) the projecting spring support pedestals 19 are provided on the end walls of the apertures 14*a*, 14*b* remote from the central support wall 36.

The operation of the FIGS. 8–10 embodiment is functionally identical to that of the FIGS. 5–7 embodiment, with any movement of the crossbar 12 in a direction to open fused contact pairs resulting in the crossbar being cammed downwardly by the stationary movable contact member 16 of such pairs and being wedged against the slide surface 1O*a* of the base during the initial spring decompression travel, to thereby prevent the closure of any open contact pairs.

What is claimed is:

1. An electromagnetic contactor, comprising:

(a) a contactor body having a base (10);

(b) a crossbar (12) slidably mounted on said base and having a plurality of elongate apertures (14) therein defining guide surfaces;

(c) a plurality of movable contact members (16) individually slidably supported in said apertures on said guide surfaces, having movable contacts (22) mounted thereon, and being biased towards an end of said apertures;

(d) a plurality of fixed contacts (26) disposed in confronting relation to said movable contacts, respectively;

(e) said movable and fixed contacts jointly constituting normally open and normally closed contact pairs so that electrical circuits controlled by the contactor can be opened and closed in response to the sliding movement of said crossbar; and (f) said guide surfaces (18*a*, 18*b*; 18*c*, 18*d*) in each aperture being linear and continuously inclined at two different angles relative to the direction of movement of said crossbar throughout the lengths of the apertures to ensure that a movable contact member of a closed contact pair is always supported on inclined guide surfaces, to thus accommodate, respectively, a movable contact member for either normally open or normally closed contact pairs, and to thereby haltingly wedge said crossbar against said base during the sliding movement of the crossbar with a closed contact pair fused together.

2. A contactor according to claim 1, wherein said inclined guide surfaces of different angles merge into each other at a central portion of each aperture, wherein said base has a slide surface (1O*a*) on which said crossbar is slidable, and wherein said central portion is positioned close to said slide surface.

3. A contactor according to claim 1, further comprising a plurality of springs (20) for individually biasing said movable contact members toward ends of said apertures.

4. A contactor according to claim 3, wherein each of said springs is supported on one end of an associated aperture by a spring seat.

5. A contactor according to claim 1, wherein each aperture is divided into two separate aperture portions (14*a*, 14*b*) by central support wall means (36) acting as an abutment for a movable contact member.

6. A contactor according to claim 5, wherein said base has a slide surface (10*a*) on which said crossbar is slidable, said guide surfaces being inclined in directions to cause movable contact members of closed contact pairs to move away from said slide surface of said base as said crossbar is moved in a direction to open said closed contact pairs.

* * * * *